US012453456B2

(12) United States Patent
Dunaway

(10) Patent No.: US 12,453,456 B2
(45) Date of Patent: Oct. 28, 2025

(54) ARTICULATING SKI ASSEMBLY FOR A LOWER RACK OF A DISHWASHING APPLIANCE

(71) Applicant: Haier US Appliance Solutions, Inc., Wilmington, DE (US)

(72) Inventor: Logan Chayse Dunaway, Greenville, IN (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 41 days.

(21) Appl. No.: 18/517,819

(22) Filed: Nov. 22, 2023

(65) Prior Publication Data

US 2025/0160607 A1 May 22, 2025

(51) Int. Cl.
*A47L 15/50* (2006.01)
*A47L 15/42* (2006.01)

(52) U.S. Cl.
CPC ..... *A47L 15/507* (2013.01); *A47L 15/4246* (2013.01); *A47L 15/4261* (2013.01)

(58) Field of Classification Search
CPC . A47L 15/507; A47L 15/4246; A47L 15/4261
USPC ..... 211/41.9
See application file for complete search history.

(56) References Cited

U.S. PATENT DOCUMENTS

| | | | | |
|---|---|---|---|---|
| 10,178,938 | B2 | 1/2019 | Bhajak et al. | |
| 10,772,481 | B2 * | 9/2020 | Agrawal | A47L 15/507 |
| 11,389,047 | B2 * | 7/2022 | Singhal | A47L 15/507 |
| 2009/0038657 | A1 | 2/2009 | Kang | |
| 2009/0151758 | A1 * | 6/2009 | Kristensson | A47L 15/507 134/201 |

FOREIGN PATENT DOCUMENTS

| | | | |
|---|---|---|---|
| CN | 107397522 | B | 4/2023 |
| RU | 33080 | U1 | 10/2003 |

* cited by examiner

*Primary Examiner* — Bradley Duckworth
(74) *Attorney, Agent, or Firm* — Dority & Manning, P.A.

(57) ABSTRACT

An articulating ski assembly for a lower rack of a dishwashing appliance may include a ski bracket attached to the lower rack assembly. The articulating ski assembly may also include a hub that may extend from the ski bracket. The articulating ski assembly may further include a ski. The ski may include an articulation ring attached to the hub to provide an articulation joint for the ski. The ski may further include a base, a tip, and a tail. The base may be positioned at a bottom of the articulation ring. The tip may extend transversely from a first end of the base. The tail may extend transversely from a second end of the base.

19 Claims, 7 Drawing Sheets

ARTICULATING SKI ASSEMBLY FOR A LOWER RACK OF A DISHWASHING APPLIANCE

FIELD OF THE DISCLOSURE

The present subject matter relates generally to a slide assembly for supporting an appliance rack, such as in a dishwashing appliance.

BACKGROUND OF THE DISCLOSURE

Dishwashing appliances generally include a tub that defines a wash chamber. Rack assemblies can be mounted within the wash chamber of the tub for receipt of articles for washing. Certain dishwashing appliances also include slide assemblies for supporting and enabling movement of the rack assemblies. A user can load articles, such as plates, bowls, glasses, or cups, into the rack assembly, and the rack assembly can support such articles within the wash chamber during operation of the dishwashing appliance. Spray assemblies within the wash chamber can apply or direct wash fluid towards articles disposed within the rack assemblies in order to clean such articles. Multiple spray assemblies can be provided, including, for example, a lower spray arm assembly mounted to the tub at a bottom of the wash chamber; a mid-level spray arm assembly mounted to one of the rack assemblies; or an upper spray assembly mounted to the tub at a top of the wash chamber. Other configurations may be used as well.

Conventional dishwasher appliances include rack support assemblies for supporting racks within the wash chamber. These rack support assemblies permit a user to slide the rack out from the wash chamber and onto the opened dishwasher door for emptying and loading dishes into the wash chamber for running a wash cycle. Typical racks are slidable into and out of the wash chamber between cycles for removing and loading dishes but rely on roller assemblies to achieve such movement. Particularly, carrier roller assemblies are typically mounted to the rack and include a plurality of rollers that roll along the dishwasher door which opens to a horizontal position. Notably, however, to travel between the wash chamber and the door, the carrier roller assemblies must traverse a gap between tracks within the wash chamber and tracks on the door. During this transition, carrier roller assemblies typically sink into this gap and then climb the opposite side, jarring the rack and its contents. This jarring transition (e.g., more commonly known as "rack jump") may cause damage to delicate dishes or at least the perception of damage among users, which decreases satisfaction with the appliance.

Accordingly, a dishwasher appliance that utilizes an improved rack support assembly would be useful. More specifically, a rack support assembly that mitigates or prevents rack jump as the rack transitions from a tub to a door would be desirable.

BRIEF DESCRIPTION OF THE DISCLOSURE

Aspects and advantages of the invention will be set forth in part in the following description, or may be obvious from the description, or may be learned through practice of the invention.

In one exemplary aspect of the present disclosure, an articulating ski assembly for a lower rack of a dishwashing appliance is provided. The articulating ski assembly may include a ski bracket attached to the lower rack assembly.

The articulating ski assembly may also include a hub extending from the ski bracket. The articulating ski assembly may further include a ski foot (SF). The SF may include an articulation ring attached to the hub to provide an articulation joint for the SF. The SF may further include a base, a tip, and a tail. The base may be positioned at a bottom of the articulation ring. The tip may be extended transversely from a first end of the base. The tail may be extended transversely from a second end of the base.

In another exemplary aspect of the present disclosure, an articulating ski assembly for a lower rack of a dishwashing appliance is provided. The articulating ski assembly may include a ski bracket attached to the lower rack assembly. The ski bracket may define a tip side and a tail side longitudinally spaced apart. The articulating ski assembly may also include a hub extending from the ski bracket. The articulating ski assembly may further include a tip suspension arm extending downward from the ski bracket toward the tip side to dampen forward articulation of the ski assembly. The articulating ski assembly may also include a tail suspension arm extending downward from the ski bracket toward the tail side to dampen rearward articulation of the ski assembly. The articulating ski assembly may further include a ski foot (SF). The SF may include an articulation ring, a base, a tip, and a tail. The base may be positioned at a bottom of the articulation ring. The tip extending from the base toward the tip side of the ski bracket. The tail extending from the base toward the tail side of the ski bracket. The articulation ring may be attached to the hub to provide an articulation joint for the ski.

In yet another exemplary aspect of the present subject matter, a dishwashing appliance is provided. The dishwashing appliance may define a vertical direction, a lateral direction, and a transverse direction. The dishwasher appliance may include a wash tub that defines a wash chamber for receipt of articles for washing. The dishwashing appliance may also include a lower rack assembly slidably positioned within the wash chamber. The lower rack assembly may be configured for movement along the transverse direction between a retracted position and an extended loading position. The dishwashing appliance may also include a door rotatably mounted to the wash tub for providing selective access to the wash chamber. The dishwashing appliance may further include a lower rack support system. The lower rack support system may include a door track extending along the door perpendicular to the lateral direction. The lower rack support system may further include a tub track extending along the wash tub in the transverse direction. The lower rack support system may also include an articulating ski assembly. The articulating ski assembly may include a ski bracket attached to the lower rack assembly. The ski bracket may define a tip side and a tail side. The ski bracket may include a hub extending outward from the ski bracket. The articulating ski assembly may also include a ski foot (SF). The SF may include an articulation ring, a base, a tip, and a tail. The base may be positioned at a bottom of the articulation ring. The tip may be extended from the base toward the tip side of the ski bracket. The tail may be extended from the base toward the tail side of the ski bracket. The articulation ring may be attached to the hub to provide an articulation joint for the ski.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
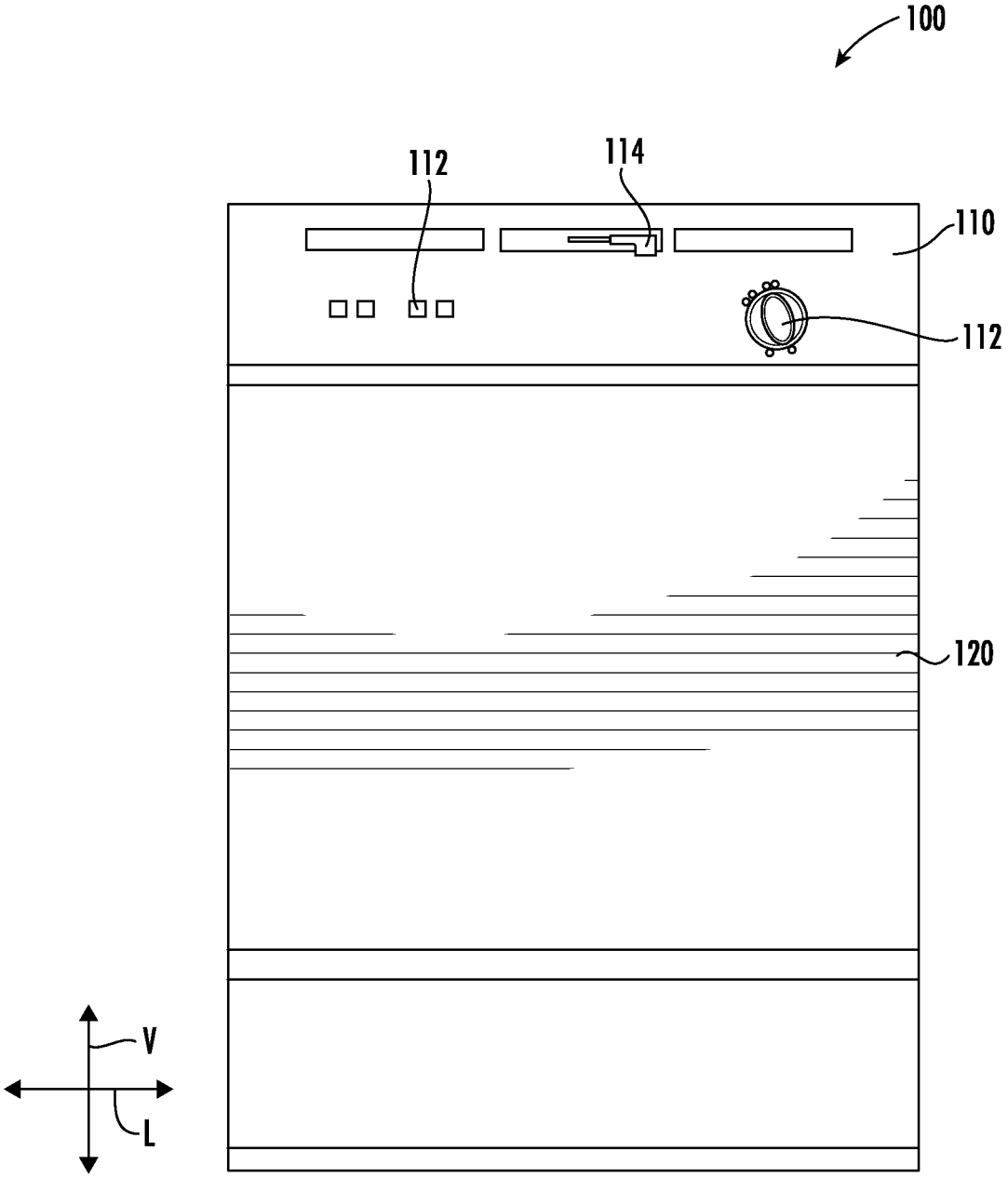
FIG. 1 provides a front elevation view of a dishwashing appliance according to one or more exemplary embodiments of the present subject matter.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both").

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components or systems. For example, the approximating language may refer to being within a ten percent margin, i.e., including values within ten percent greater or less than the stated value. In this regard, for example, when used in the context of an angle or direction, such terms include within ten degrees greater or less than the stated angle or direction, e.g., "generally vertical" includes forming an angle of up to ten degrees in any direction, e.g., clockwise, or counterclockwise, with the vertical direction V.

Figure 2:
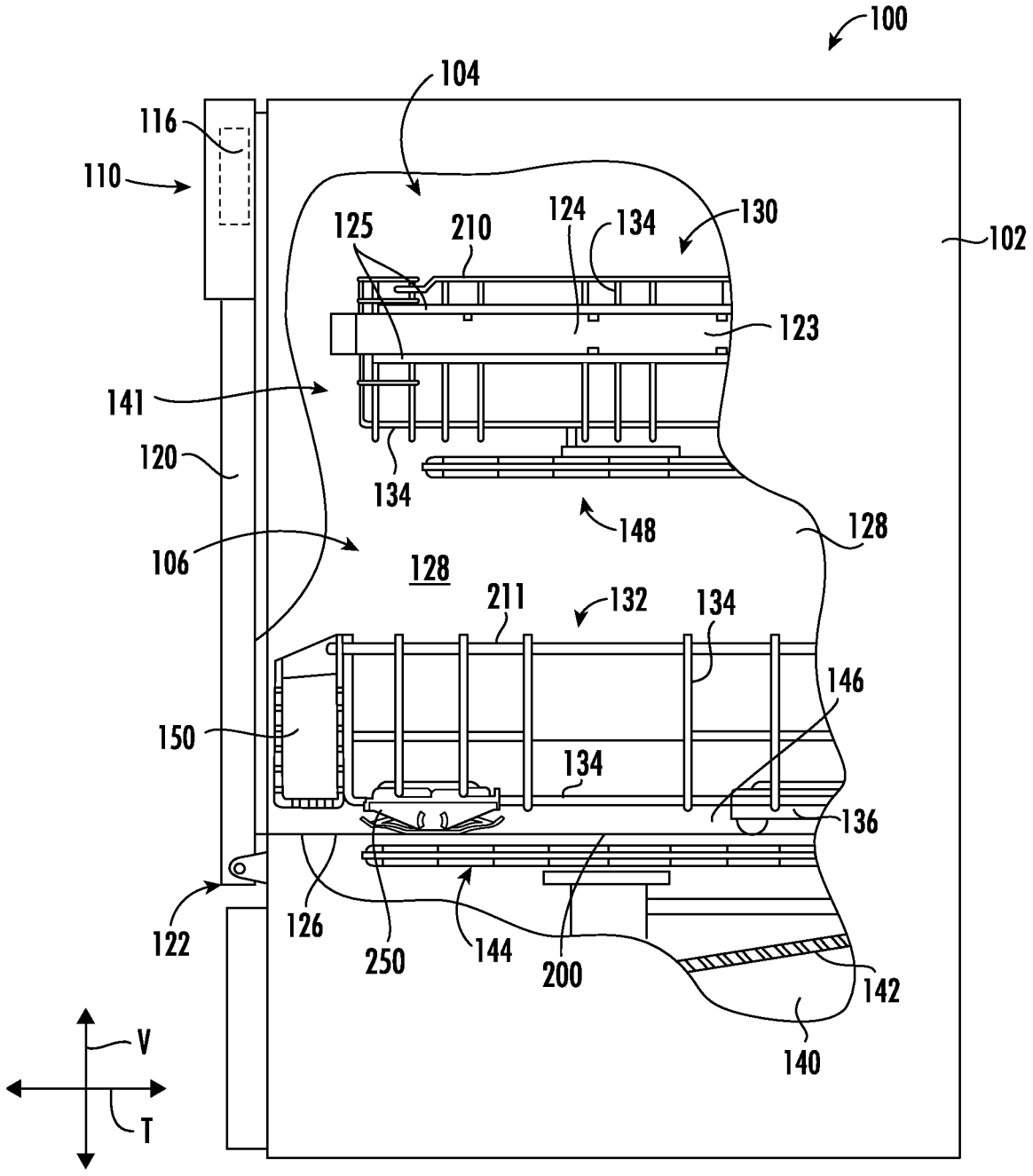
FIG. 2 provides a side, partially cut away view of the exemplary dishwashing appliance of FIG. 1.

Referring now to FIGS. 1 and 2, a dishwashing appliance 100 according to one or more exemplary embodiments of the present subject matter is provided. Specifically, FIG. 1 provides a front elevation view of the dishwashing appliance 100 and FIG. 2 provides a side, partially cut away view of the dishwashing appliance 100 of FIG. 1. As depicted, the dishwashing appliance 100 may define a vertical direction V, a lateral direction L, and a transverse direction T. The vertical direction V, the lateral direction L, and the transverse direction T each being mutually perpendicular with every other, such that an orthogonal direction system is generally defined.

The dishwashing appliance 100 may include a cabinet 102 having a tub 104 therein that defines a wash chamber 106. The tub 104 may include a front opening and a door 120 that may be hinged at a bottom 122 for movement between a normally closed vertical position, e.g., FIGS. 1 and 2, wherein the wash chamber 106 is sealed shut for washing operation, and a horizontal open position (not depicted), wherein the loading and unloading of articles from the dishwashing appliance 100 may occur. In some instances, such as depicted in FIG. 1, the dishwashing appliance 100 may include a latch 114 that may be used to lock and unlock the door 120 such that access to the wash chamber 106 may be permitted or restricted.

In addition, the dishwashing appliance 100 may include one or more rack assemblies, such as an upper rack assembly 130 and a lower rack assembly 132, that may be used to load articles in the dishwashing appliance 100. In some embodiments, the upper rack assembly 130 may be mounted within the dishwashing appliance 100 in an upper region 141 of the wash chamber 106, e.g., above the lower rack assembly 132 with respect to the vertical direction V.

The upper rack assembly 130 and the lower rack assembly 132 may each include a dish rack for holding articles therein, e.g., for the cleaning of the articles. For instance, the upper rack assembly 130 may include an upper dish rack 210 and the lower rack assembly 132 may include a lower dish rack 211. The dish racks 210, 211 may each include a plurality of elongated members or rails 134 that may each be extended in the lateral direction L, the transverse direction T, and the vertical direction V. The plurality of rails 134 may be wires, rods, or any other suitable member, which may be fabricated into a lattice structure to form the shape of the respective dish rack 210, 211.

The upper rack assembly 130 and the lower rack assembly 132 may each be adapted for movement substantially along the transverse direction T. For instance, the upper rack assembly 130 and the lower rack assembly 132 may be movable between an extended loading position (not shown) and a retracted position. In the extended loading position, the upper rack assembly 130 or the lower rack assembly 132 is positioned substantially outside the wash chamber 106 (e.g., for the receipt of articles such as pots, plates, bowls, silverware, etc.). In the retracted positioned (e.g., FIGS. 1 and 2) the upper rack assembly 130 or the lower rack assembly 132 is located entirely within the wash chamber 106.

The movement of the upper rack assembly 130 may be facilitated by an upper rack support system 123. For instance, as illustrated in FIG. 2, the upper rack support system 123 may include a pair of slide assemblies 124 that are positioned at opposing lateral sides of the upper rack assembly 130. Additionally, the movement of the lower rack assembly 132 may be facilitated by a lower rack support system 200. The lower rack support system 200 may include a pair of articulating ski assemblies 250. As will be appreciated in more detail below, the pair of articulating ski assemblies 250 may include features that are configured to prevent or mitigate rack jump. Additionally, in some embodiments, the lower rack support system 200 may include a pair of roller slide assemblies 136 positioned at, or proximate to, a rear end of the lower rack assembly 132.

As used herein "rack jump" generally refers to a jarring or jumping (or the perception of jarring or jumping) of the lower rack assembly 132 as the lower rack assembly 132 is transitioned between the retracted position and the extended loading position. Specifically, rack jump may occur when the movement mechanism of the lower rack support system traverses over a gap 198 (see e.g., FIG. 3) that may be positioned between the tub 104 and the door 120. In this regard, the pair of articulating ski assemblies 250 may be provided to reduce or eliminate the effects of rack jump.

As should be appreciated, the configuration of the lower rack support system 200 illustrated in FIG. 2 may be provided by way of example only. For instance, in some other exemplary embodiments, the lower rack support system 200 may include at least one pair of articulating ski assemblies 250. For example, in some other exemplary embodiments, the lower rack support system 200 may include two pairs of articulating ski assemblies 250, such as an additional pair of articulating ski assemblies 250 that replaces or supplements the pair of roller slide assemblies 136.

Optionally, a silverware basket 150 may be removably attached to the lower rack assembly 132 for placement of silverware, small utensils, and the like, which are too small to be accommodated by the upper rack assembly 130 and the lower rack assembly 132.

Further, the dishwashing appliance 100 may include a lower spray assembly 144 that may be rotatably mounted within a lower region 146 of the wash chamber 106 and above a tub sump portion 142 so as to rotate in relatively close proximity to the lower rack assembly 132, e.g., in closer proximity to the lower rack assembly 132 than to the upper rack assembly 130. In addition, the dishwashing appliance 100 may include a mid-level spray assembly 148 that may be located in the upper region 141 of the wash chamber 106 and may be attached to, or located in close proximity to, the upper rack assembly 130, e.g., the mid-level spray assembly 148 may be in "close proximity" to the upper rack assembly 130 in that the mid-level spray assembly 148 is closer to the upper rack assembly 130 than to the lower rack assembly 132. In some embodiments an upper spray assembly (not shown) may additionally be located above the upper rack assembly 130.

The lower spray assembly 144, the mid-level spray assembly 148, and the upper spray assembly may be fed by a fluid circulation assembly that may be configured for circulating water and wash fluid in the tub 104. Portions of the fluid circulation assembly may be located in a machinery compartment 140 located below the bottom sump portion 142 of the tub 104, as generally recognized in the art. Each spray assembly, e.g., lower spray assembly 144, mid-level spray assembly 148, and upper spray assembly, may include an arrangement of discharge ports or orifices for directing washing liquid onto dishes or other articles located in the upper rack assembly 130 and the lower rack assembly 132, respectively. The arrangement of the discharge ports in at least the lower spray assembly 144 may provide a rotational force by virtue of the washing fluid flowing through the discharge ports. The resultant rotation of the lower spray assembly 144 may provide coverage of dishes and other articles with a washing spray.

The dishwashing appliance 100 may further be equipped with a controller 116 to regulate operation of dishwashing appliance 100. The controller 116 may include a memory (e.g., non-transitive memory) and microprocessor, such as a general or special purpose microprocessor operable to execute programming instructions or micro-control code associated with a cleaning cycle. The memory may represent random access memory such as DRAM or may represent read only memory such as ROM or FLASH. In one embodiment, the processor executes programming instructions stored in memory. The memory may be a separate component from the processor or may be included onboard within the processor.

The controller 116 may be positioned in a variety of locations throughout dishwashing appliance 100. For example, as depicted in FIGS. 1 and 2, the controller 116 may be located within a control panel area 110 of the door 120. In such an embodiment, input/output ("I/O") signals may be routed between the control system and various operational components of dishwashing appliance 100 along wiring harnesses that may be routed through bottom 122 of door 120. In certain embodiments, the control panel area 110 may include input components 112 through which a user may select various operational features and modes and monitor progress of the dishwashing appliance 100. For instance, in some embodiments, input components 112 may be a variety of electrical, mechanical, or electro-mechanical input devices including rotary dials (e.g., FIG. 1), push buttons (e.g., FIG. 1), or touch pads, etc. In some embodiments, the control panel area 110 may include a display component, such as a digital or analog display device designed to provide operational feedback to a user. The input components 112 may be in communication with controller 116 via one or more signal lines or shared communication busses.

It should be appreciated that the present subject matter is not limited to any particular style, model, or configuration of dishwashing appliance. Thus, the exemplary embodiment depicted in FIGS. 1 and 2 are for illustrative purposes only. For example, different locations may be provided for the input components 112, different configurations may be provided for the upper rack assembly 130 and the lower rack assembly 132, and other differences may be applied as well.

Figure 3:
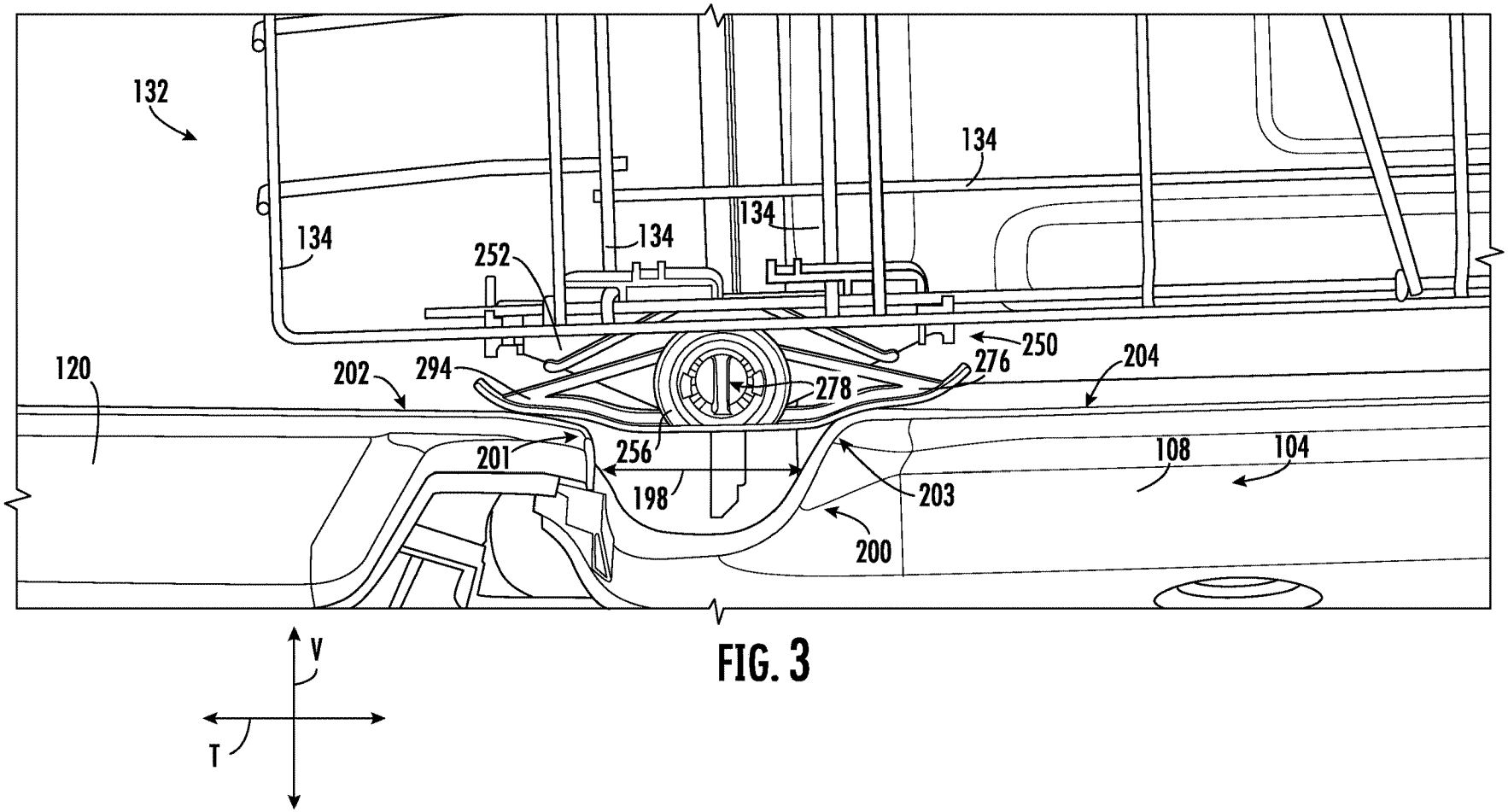
FIG. 3 provides a perspective view of a rack support assembly as the rack transitions between a retracted position and an extended loading position according to one or more exemplary embodiments of the present subject matter.

Referring now to FIG. 3, a perspective view of the lower rack support system 200 according to one or more exemplary embodiments of the present subject matter is provided. In some embodiments, the lower rack support system 200 includes a door track 202 extending along door 120 perpendicular to the lateral direction L. Additionally, in some embodiments, the door track 202 is attached to or integral with door 120. Further, the door track 202 may be raised from the surface of door 120 such that the surface of door 120 and the parallel surface of door track 202 are spaced apart from one another, creating a lip or ridge on door 120. When the lower rack assembly 132 slides out of the wash chamber 106 (e.g., to the extended loading position) at least partially above door 120, door track 202 may support one or more of articulating ski assemblies 250 or the roller slides assemblies 136. A second parallel door track may be employed at the same height on the opposite side of door 120 to support articulating ski assemblies 250 or roller assemblies 136 of the lower rack assembly 132 on that side as well. Additionally, in embodiments employing additional articulating ski assemblies 250 or roller assemblies 136, the door track 202 would likewise support those as well. The articulating ski assemblies 250 or roller assemblies 136, in turn, support the lower rack assembly 132 and its contents.

In some embodiments, the lower rack support system 200 includes a tub track 204 extending along wash tub 104 in the transverse direction T. Additionally, the tub track 204 may be attached to or integral with wash tub 104. As shown, the tub track 204 may be raised from the bottom 108 of wash tub 104, forming a lip or ridge in wash tub 104. When the lower rack assembly 132 slides into wash chamber 106, the lower rack assembly 132 is in the retracted position. In the retracted position, the articulating ski assemblies 250 or the roller assemblies 136 are supported by tub track 204. A second parallel tub track may be employed at the same height on the opposite side of wash tub 104 to support articulating ski assemblies 250 and roller assemblies 130 on that side as well. In embodiments employing additional articulating ski assemblies 250 or roller assemblies 136 door track 202 would likewise support those as well. The articulating ski assemblies 250 or roller assemblies 136 in turn support the lower rack assembly 132 and its contents. In the open position of the door 120, the door tracks 202 and tub tracks 204 may be aligned along a common axis parallel to the transverse direction T.

Referring now to FIGS. 4 through 7 embodiments of the articulating ski assembly 250 according to one or more exemplary aspects of the present subject matter are provided. The articulating ski assembly 250 may include a ski bracket 252, a hub 254, and a ski 256. The ski bracket 252 may be attached to the lower rack assembly 132. The ski bracket 252 may define a tip side 258 and a tail side that may be spaced apart approximately along the transverse direction T. The ski bracket 252 may generally include a rack portion 262 and a ski portion 264. The rack portion 262 may be attached to the lower rack assembly 132 and may include one or more hooks 266. The one or more hooks 266 may each define a slot 268 that is configured to receive a discrete rail 134 of the lower rack assembly 132. In this regard, the ski bracket 252 may be attached to the lower rack assembly 132 at the one or more hooks 266.

Additionally, the ski portion 264 may be positioned, at least in part, below the rack portion 262 (e.g., approximately along the vertical direction V). For instance, as illustrated in FIGS. 4 through 7, the ski portion 264 may be a triangular shaped portion that extends downwards (e.g., approximately along the vertical direction V) from the rack portion 262. In some embodiments, the hub 254 is extended outward (e.g., approximately along the lateral direction L) from the ski bracket 252, and more particularly, from the ski portion 264 of the ski bracket 252.

Further, the ski 256 may include an articulation ring 270, a base 272, a tip 274, and a tail 276. In general, the articulation ring 270 may be attached to the hub 254 such that the hub 254 and the articulation ring 270 provide an articulation joint 278 for the articulating ski assembly 250. As will be appreciated, the ski 256 may be articulable about the articulation joint 278 between one or more relative positions.

The hub 254 may include a hub frame 280 and a plurality of resilient appendages 282. Each resilient appendage 282 may be circumferentially spaced apart around the hub frame 280. Additionally, each resilient appendage 282 may include a tab 284. Each tab 184 may be extended outward from a distal end of the respective resilient appendage 282. Further, the articulation ring 270 may include an outer rim 286 and an inner rim 288, wherein the inner rim 288 may define an opening 290 for receiving the hub 254. In some embodiments, the tab 284 of each resilient appendage 282 is interfaced with the inner rim 288 of the articulation ring 270 to secure the ski 256 to the hub 254.

Figure 4:
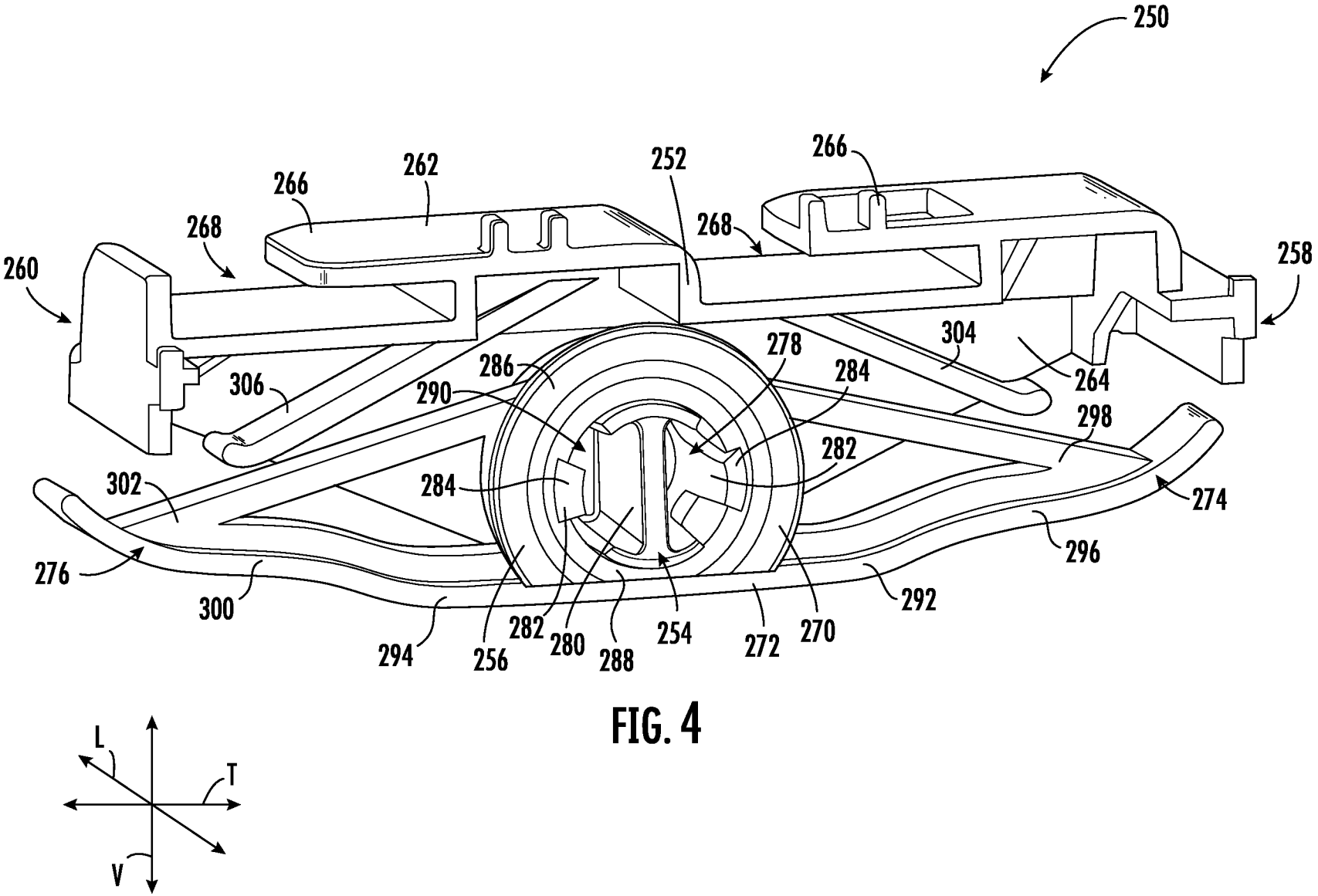
FIG. 4 provides a perspective view of an articulating ski assembly according to one or more exemplary embodiments of the present subject matter.
Figure 5:
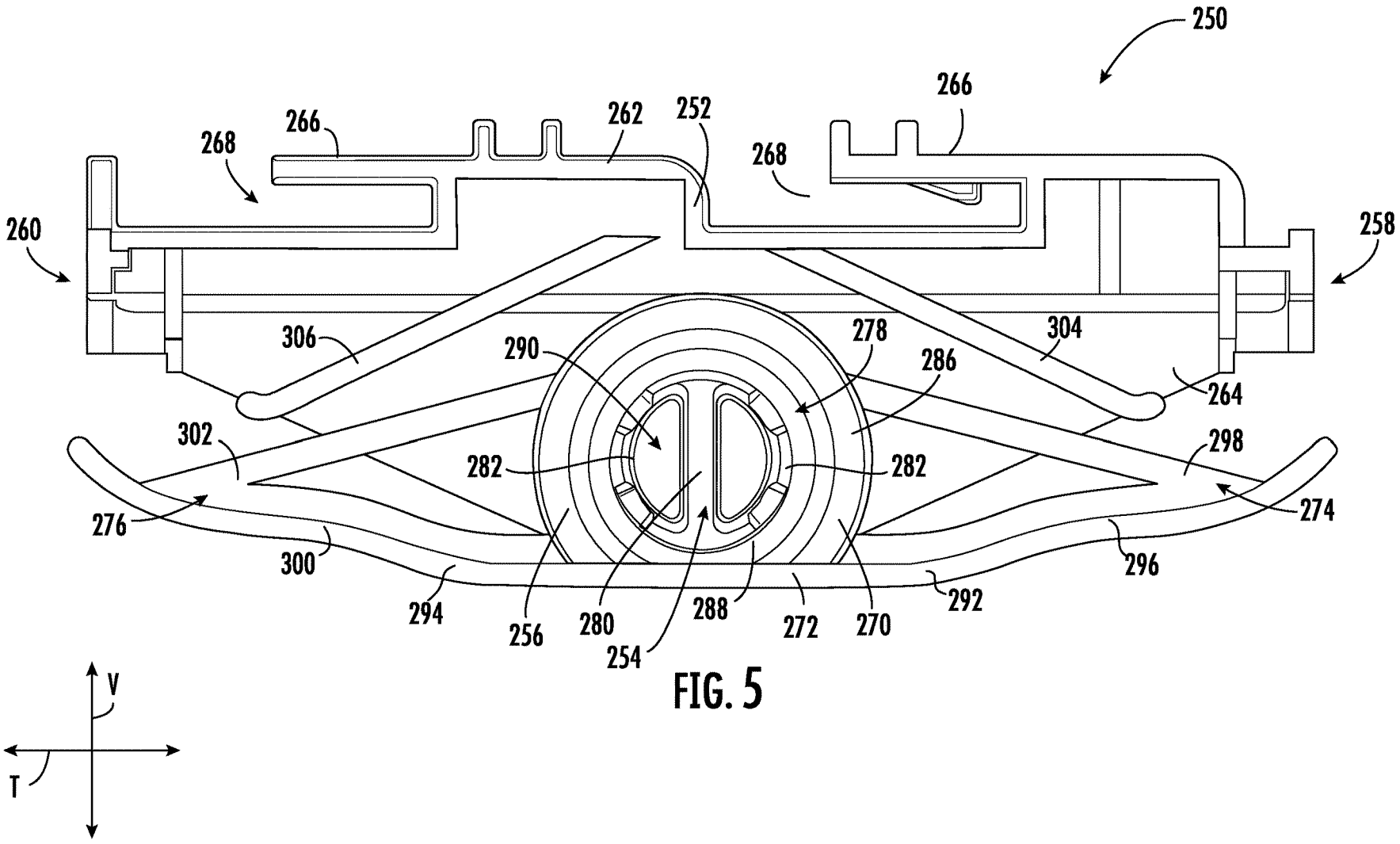
FIG. 5 provides a front elevation view of the articulating ski assembly of FIG. 1 in a neutral position.
Figure 6:
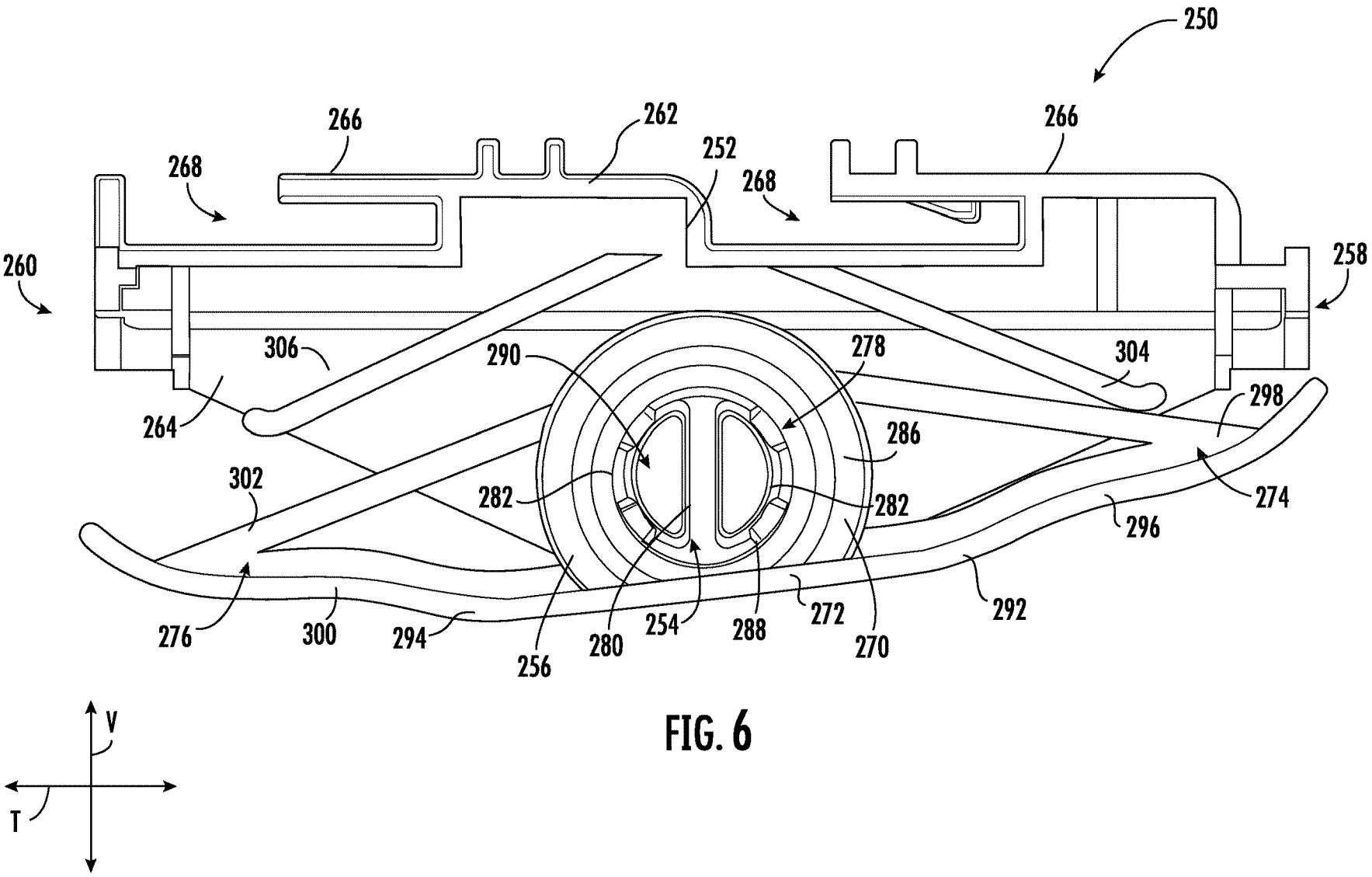
FIG. 6 provides a front elevation view of the articulating ski assembly of FIG. 1 in an upward position.

As an illustrative example, during assembly of the articulating ski assembly 250, an operator of the appliance may motivate or urge the plurality of resilient appendages 282 inward toward the hub frame 280 such that each tab 284 may be cleared from the inner rim 288. For example, an operator of the appliance may apply a force to each resilient appendage 282 that may motivate or urge each resilient appendage 282 inward. In this regard, the hub 254 may be inserted into the opening 290 defined by the inner rim 288. Once the hub 254 is positioned within the opening 290 of the articulation ring 270, the forces applied to the plurality of resilient appendages 282 may be removed and the plurality of resilient appendages 282 may return to their original position (e.g., as depicted in FIG. 4) as the plurality of resilient appendages 282 may be biased toward the original position.

Optionally, the base 272 may be positioned at a bottom of the articulation ring 270 to provide a flat surface for the articulation ring 270. For instance, the flat surface of the base 272 may be utilized to interface with the door track 202 or the tub track 204. Further, the base 272 may include a first end 292 and a second end 294 that are spaced apart approximately along the transverse direction T. The tip 274 may extend from the first end 292 of the base 272 toward the tip side 258 of the ski bracket 252. For instance, as illustrated in FIGS. 4 through 7, at least a portion of the tip 274 may extend outward (e.g., approximately along the transverse direction T) and at least a portion of the tip 274 may extend upward (approximately along the vertical direction V) such that the tip 274 is extended toward the tip side 258 of the ski bracket 252. The tail 276 may extend from the second end 294 of the base 272 toward the tail side 260 of the ski bracket 252. For instance, as illustrated in FIGS. 4 through 7, at least a portion of the tail 276 may extend outward (e.g., approximately along the transverse direction T) and at least a portion of the tail 276 may extend upward (approximately along the vertical direction V) such that the tail 276 is extended toward the tail side 260 of the ski bracket 252.

Further, in some embodiments, the tip 274 may include a serpentine tip body 296 and a tip frame 298. The serpentine tip body 296 may define multiple undulations that together may form a curving or wave-shaped surface of the tip 274. The curving or wave-shaped surface of the serpentine tip body 296 may advantageously soften the articulation of the articulating ski assembly 250 as the tip 274 traverses over the gap 198. This softening of the articulation of the articulating ski assembly 250 may facilitate the mitigation or prevention of rack jump. For instance, the curving shape of the serpentine tip body 296 may complement a rearward end 201 of the door 120 and a frontward end 203 of the bottom 108 of the wash tub 104. In this regard, as the tip 274 passes over the rearward end 201 of the door 120 or the frontward end 203 of the bottom 108 of the wash tub 104, the serpentine tip body 296 may soften the articulation of the articulating ski assembly 250. Additionally, the tip frame 298 may be positioned between the articulation ring 270 and the serpentine tip body 296 (e.g., relative to the transverse direction T). In this regard, the tip frame 298 may support the tip 274, and more particularly, the serpentine tip body 296.

Additionally, in some exemplary embodiments, the tail 276 may include a serpentine tail body 300 and a tail frame 302. The serpentine tail body 300 may define multiple undulations that together may form a curving or wave-shaped surface of the tail 276. The curving or wave-shaped surface of the serpentine tail body 300 may advantageously soften the articulation of the articulating ski assembly 250 as the tail 276 traverses over the gap 198. This softening of the articulation of the articulating ski assembly 250 may facilitate in the mitigation or prevention of rack jump. For instance, the curving shape of the serpentine tail body 300 may complement the rearward end 201 of the door 120 and the frontward end 203 of the bottom 108 of the wash tub 104. In this regard, as the tail 276 passes over the rearward end 201 of the door 120 or the frontward end 203 of the bottom 108 of the wash tub 104, the serpentine tail body 300 may soften the articulation of the articulating ski assembly 250. Additionally, the tail frame 302 may be positioned between the articulation ring 270 and the serpentine tail body 300. In this regard, the tail frame 302 may support the tail 276, and more particularly, the serpentine tail body 300.

In some embodiments, the articulating ski assembly 250 may also include a tip suspension arm 304 and a tail suspension arm 306. The tip suspension arm 304 may be extended downward from the rack portion 262 of the ski bracket 252 toward the tip side 258 of the ski bracket 252. The tail suspension arm 306 may be extended downward from the rack portion 262 of the ski bracket 252 toward the tail side 260 of the ski bracket 252. As will be appreciated, the tip suspension arm 304 and the tail suspension arm 306 may (e.g., alone or in concert) dampen the articulation of the ski 256 between one or more positions described in more detail below.

Figure 7:
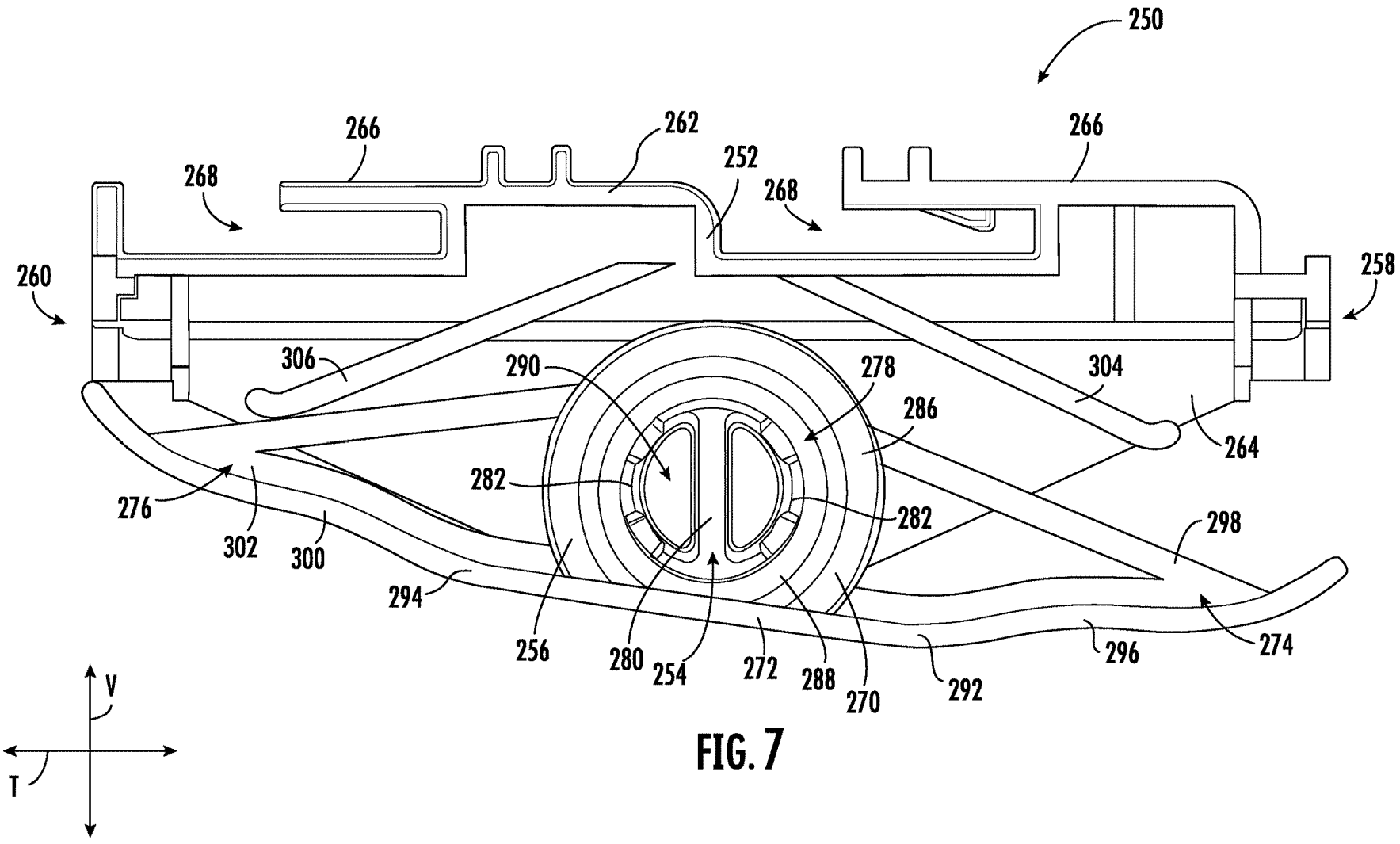
FIG. 7 provides a front elevation view of the articulating ski assembly of FIG. 1 in a downward position.

The ski 256 may be articulable about the articulation joint 278 between a neutral position (FIG. 5), an upward position (FIG. 6), and a downward position (FIG. 7). In the upward position, the ski 256 may be articulated such that the tip 274 is positioned, at least in part, above the tail 276. In some embodiments, in the upward position, the tip suspension arm 304 is interfaced with the tip 274 to dampen the articulation of the ski 256. In the downward position, the ski 256 may be articulated such that the tail 276 is positioned, at least in part, above the tip 274. In some embodiments, in the downward position, the tail suspension arm 306 is interfaced with the tail 276 to dampen the articulation of the ski 256.

As an illustrative example, as the lower rack assembly 132 is transitioned between the retracted position to the extended loading position, the articulating ski assembly 250 may move between the tub track 204 to the door track 202. During this time, the articulating ski assembly 250 may pass over a gap 198 (e.g., FIG. 3) defined between the tub track 204 and the door track 202. As a portion of the articulating ski assembly 250, and more particularly, the ski 256 passes over the gap 198, the weight of the lower rack assembly 132 may cause the ski 256 to articulate toward one of the one or more positions. For instance, when the tip 274 is positioned over (e.g., directly above) the gap 198, the ski 256 may articulate toward the downward position (e.g., FIG. 7). Additionally, when the tail 276 is positioned over (e.g., directly above) the gap 198, the ski may articulate toward the upward position (e.g., FIG. 6).

This articulation of the ski 256 in combination with movement of the articulating ski assembly 250 (e.g., in or along the transverse direction T) may result in a smooth transition of the lower rack assembly 132 over the gap 198. Additionally, as described in more detail above, one or more features of the articulating ski assembly 250 may soften or dampen movement of the lower rack assembly (e.g., to further mitigate or prevent rack jump). For instance, the curving shapes of the serpentine tip body 296 and the serpentine tail body 300 may provide a softened transition over the gap 198. Additionally, the tip suspension arm 304 or the tail suspension arm 306 may dampen articulation of the ski 256. For instance, when the ski 256 is in the upward position, the tip frame 298 may engage with the tip suspension arm 304 to dampen (e.g., slow down) the articulation of the ski 256. Additionally, when the ski 256 is in the downward position, the tail frame 302 may engage with the tail suspension arm 306 to dampen the articulation of the ski 256. In this regard, the tip suspension arm 304 or the tail suspension arm 306 may function as a cantilever spring that is configured to dampen the articulation of the ski 256.

Embodiments of the present subject matter advantageously provide a dishwashing appliance that includes an articulating ski assembly that is configured to mitigate or prevent rack "jump" between the tub and the door of the dishwashing appliance. The articulating ski assembly may advantageously include a ski that is capable of articulating about a hub of a ski bracket. The articulation of the ski may mitigate or prevent rack "jump" between the tub and the door of the dishwashing appliance. Additionally, the one or more suspension components (e.g., the tip suspension arm and the tail suspension arm) may dampen the articulation of the ski about the hub to further mitigate or prevent rack "jump" between the tub and the door. Further, the articulating ski assembly may advantageously include a serpentine tip body and a serpentine tail body that may facilitate a softened transition of the articulating ski assembly over a gap between the tub and the door.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An articulating ski assembly for a lower rack assembly of a dishwashing appliance, the articulating ski assembly comprising:

a ski bracket attached to the lower rack assembly;

a hub extending from the ski bracket; and a ski foot (SF) comprising an articulation ring attached to the hub to provide an articulation joint for the SF, the SF further comprising a base, a tip, and a tail, the base being positioned at a bottom of the articulation ring, the tip extending transversely from a first end of the base, and the tail extending transversely from a second end of the base.

2. The articulating ski assembly of claim 1, wherein the tip comprises a serpentine tip body and a tip frame, wherein the tip frame is positioned between the articulation ring and the serpentine tip body, and wherein the serpentine tip body is supported by the tip frame.

3. The articulating ski assembly of claim 1, wherein the tail comprises a serpentine tail body and a tail frame, wherein the tail frame is positioned between the articulation ring and the serpentine tail body, and wherein the serpentine tail body is supported by the tail frame.

4. The articulating ski assembly of claim 1, wherein the hub comprises a hub frame and a plurality of resilient appendages, and wherein each resilient appendage of the plurality of resilient appendages is circumferentially spaced apart around the hub frame.

5. The articulating ski assembly of claim 4, wherein the articulation ring comprises an inner rim positioned circumferentially around the hub, wherein each resilient appendage of the plurality of resilient appendages comprises a tab, and wherein each tab is interfaced with the inner rim to attach the hub to the articulation ring.

6. The articulating ski assembly of claim 1, wherein the ski bracket comprises a rack portion, wherein the rack portion comprises one or more hooks at a top of the ski bracket, wherein the ski bracket is attached to the lower rack assembly at the one or more hooks.

7. The articulating ski assembly of claim 6, wherein the ski bracket comprises a ski portion positioned below the rack portion, wherein the hub is extended outward from the ski portion.

8. An articulating ski assembly for a lower rack assembly of a dishwashing appliance, the articulating ski assembly comprising:

a ski bracket attached to the lower rack assembly, the ski bracket defining a tip side and a tail side transversely spaced apart;

a hub extending from the ski bracket;

a tip suspension arm integrated into the ski bracket to dampen forward articulation of the ski assembly;

a tail suspension arm integrated into the ski bracket to dampen rearward articulation of the ski assembly; and a ski foot (SF) comprising an articulation ring, a base, a tip, and a tail, the base positioned at a bottom of the articulation ring, the tip extending from the base toward the tip side of the ski bracket, and the tail extending from the base toward the tail side of the ski bracket, wherein the articulation ring is attached to the hub to provide an articulation joint for the SF.

9. The articulating ski assembly of claim 8, wherein the tip comprises a serpentine tip body and a tip frame, wherein the tip frame is positioned between the articulation ring and the serpentine tip body, and wherein the serpentine tip body is supported by the tip frame.

10. The articulating ski assembly of claim 8, wherein the tail comprises a serpentine tail body and a tail frame, wherein the tail frame is positioned between the articulating ring and the serpentine tail body, and wherein the serpentine tail body is supported by the tail frame.

11. The articulating ski assembly of claim 8, wherein the SF is articulable about an axis of rotation between a neutral position, an upward position, and a downward position.

12. The articulating ski assembly of claim 11, wherein the SF is articulable to an upward position, wherein in the upward position the tip is positioned above the tail and the tip suspension arm is interfaced with the tip to dampen articulation of the SF.

13. The articulating ski assembly of claim 11, wherein the SF is articulable to a downward position, wherein in the downward position the tail is positioned above the tip and the tail suspension arm is interfaced with the tail to dampen articulation of the SF.

14. The articulating ski assembly of claim 8, wherein the hub comprises a hub frame and a plurality of resilient appendages and wherein each resilient appendage of the plurality of resilient appendages is circumferentially spaced apart around the hub frame.

15. The articulating ski assembly of claim 14, wherein the articulation ring comprises an inner rim positioned circumferentially around the hub, wherein each resilient appendage of the plurality of resilient appendages comprises a tab, and wherein each tab is interfaced with the inner rim to attach the hub to the articulation ring.

16. The articulating ski assembly of claim 8, wherein the ski bracket comprises a rack portion, wherein the rack portion comprises one or more hooks positioned at a top of the ski bracket, wherein the ski bracket is attached to the lower rack assembly at the one or more hooks.

17. A dishwashing appliance defining a vertical direction, a lateral direction, and a transverse direction, the dishwasher appliance comprising:

a wash tub that defines a wash chamber for receipt of articles for washing;

a lower rack assembly slidably positioned within the wash chamber and configured for movement along the transverse direction between a retracted position and an extended loading position;

a door rotatably mounted to the wash tub for providing selective access to the wash chamber; and a lower rack support system comprising, a door track extending along the door perpendicular to the lateral direction, a tub track extending along the wash tub in the transverse direction, and an articulating ski assembly, the articulating ski assembly comprising:

a ski bracket attached to the lower rack assembly, the ski bracket defining a tip side and a tail side;

a hub extending outward from the ski bracket; and a ski foot (SF) comprising an articulation ring, a base, a tip, and a tail, the base positioned at a bottom of the articulation ring, the tip extended from the base toward the tip side of the ski bracket, and the tail extended from the base toward the tail side of the ski bracket, wherein the articulation ring is attached to the hub to provide an articulation joint for the SF.

18. The dishwashing appliance of claim 17, wherein the ski bracket defines a tip side and a tail side spaced apart approximately along the transverse direction and wherein the articulating ski assembly further comprises:

a tip suspension arm extending downward from the ski bracket toward the tip side; and a tail suspension arm extending downward from the ski bracket toward the tail side.

19. The dishwashing appliance of claim 17, wherein the SF is articulable about an axis of rotation between a neutral position, an upward position, and a downward position.

* * * * *